US008879930B2

(12) United States Patent
Mori

(10) Patent No.: US 8,879,930 B2
(45) Date of Patent: Nov. 4, 2014

(54) IMAGE FORMING APPARATUS

(71) Applicant: KYOCERA Document Solutions Inc., Osaka (JP)

(72) Inventor: Masato Mori, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/054,882

(22) Filed: Oct. 16, 2013

(65) Prior Publication Data

US 2014/0112676 A1 Apr. 24, 2014

(30) Foreign Application Priority Data

Oct. 18, 2012 (JP) ..... 2012-231087

(51) Int. Cl.
*G03G 21/00* (2006.01)
*G03G 15/04* (2006.01)
*G03G 15/00* (2006.01)

(52) U.S. Cl.
CPC ..... *G03G 15/55* (2013.01); *G03G 15/04045* (2013.01); *G03G 21/00* (2013.01)
USPC ..... 399/34; 399/32

(58) Field of Classification Search
CPC .. G03G 15/55; G03G 15/04045; G03G 21/00
USPC ..... 399/34, 32, 31, 9, 15, 49, 98
See application file for complete search history.

(56) References Cited

U.S. PATENT DOCUMENTS 7,903,994 B2 * 3/2011 Matsumoto et al. ..... 399/98
2009/0245850 A1 * 10/2009 Kawai et al. ..... 399/98

FOREIGN PATENT DOCUMENTS

JP 2002-268341 A 9/2002

* cited by examiner

*Primary Examiner* — Billy Lactaoen
(74) *Attorney, Agent, or Firm* — Morgan, Lewis & Bockius LLP

(57) ABSTRACT

When a cleaning operation is performed, a controller of an image forming apparatus controls to emit a light beam from a light emitting window so as to form a stripe image in a predetermined position of an intermediate transfer member so as to form a image defect part in the stripe image, which occurs when a cleaning member moving in a reciprocating manner in a main scanning direction along the light emitting window blocks the light beam. In addition, the controller detects the image defect part by a density detecting member. When a predetermined number of image defect parts are not formed in the predetermined position in the period from start to end of the cleaning operation, the controller determines that the cleaning member is within the scanning range of the light beam.

10 Claims, 14 Drawing Sheets

IMAGE FORMING APPARATUS

INCORPORATION BY REFERENCE

This application is based on and claims the benefit of priority from the corresponding Japanese Patent Application No. 2012-231087 filed on Oct. 18, 2012, the entire contents of which are hereby incorporated by reference.

BACKGROUND

The present disclosure relates to an image forming apparatus equipped with an exposure device.

Conventionally, there is known an image forming apparatus, which forms an electrostatic latent image on a photoreceptor drum and develops the electrostatic latent image formed on the photoreceptor drum so as to obtain a toner image. This image forming apparatus includes an exposure device for emitting a light beam for scanning and exposing the photoreceptor drum.

The exposure device includes an exposure member constituted of a semiconductor laser element, a polygon mirror and the like, and has a structure in which the exposure member is housed in a casing. The casing is provided with an opening for emitting the exposing light beam, and the opening is closed by a transparent plate such as a glass plate for preventing toner and the like from entering into the device through the opening. In other words, the exposing light beam is emitted through the transparent plate. In this case, if toner and the like adhere to the transparent plate and contaminate the same, intensity of the exposing light beam is decreased, or the exposing light beam is scattered, so that quality of a printed image is deteriorated. Therefore, a cleaning mechanism is necessary for cleaning the transparent plate.

Conventionally, for example, a cleaning mechanism is provided, in which a cleaner is disposed so as to contact with the transparent plate, and the cleaner is moved in a main scanning direction so that the transparent plate is cleaned. This cleaning mechanism includes, in addition to the cleaner, a ball screw extending in the main scanning direction, a motor connected to the ball screw, and the like. Further, the cleaner is engaged with the ball screw. In this way, when the ball screw is driven to rotate, the cleaner is moved in the main scanning direction while contacting with the transparent plate, and hence the transparent plate is cleaned.

Conventionally, when the cleaning operation is not performed, the cleaner stands by outside a scanning range of the exposing light beam (at an initial position). When the cleaning operation is performed, the cleaner moves in the main scanning direction so as to clean the transparent plate. After that, the cleaner returns to the initial position. In this way, when the exposure device performs exposure, the exposing light beam is not blocked by the cleaner.

However, when the cleaning operation is being performed, if the cleaner is caught by a certain member or if a foreign object is pinched between the cleaner and the ball screw, the cleaner may not return to the initial position (the cleaner stays in the scanning range of the exposing light beam). In other words, an error occurs in the cleaning operation. Then, if the printing job (including exposure by the exposure device) is performed in a state where the cleaner has not returned to the initial position, the exposing light beam is blocked by the cleaner. Therefore, a position on the photoreceptor drum corresponding to the position where the cleaner stays is not exposed, and hence quality of the printed image is deteriorated.

In order to solve this inconvenience, an additional mechanism should be provided for determining whether or not the cleaner has returned to the initial position and to inhibit execution of the printing job until the cleaner returns to the initial position. For instance, if a detection sensor for detecting arrival of the cleaner is disposed at the initial position, it is possible to determine whether or not the cleaner has returned to the initial position on the basis of an output of the detection sensor. However, in this case, the detection sensor for detecting arrival of the cleaner is necessary, and hence the number of components is increased resulting in cost increase.

SUMMARY

The present disclosure is made for solving the problem described above, and it is an object thereof to provide an image forming apparatus capable of determining whether or not an error has occurred in a cleaning operation of a light emitting window through which an exposing light beam is emitted, without increasing the number of components.

In order to achieve the above-mentioned object, an image forming apparatus of the present disclosure includes an image forming portion including image carriers, electrification members, exposure members and developing units for each color, so as to form toner images of individual colors on surfaces of the image carriers, respectively, and an intermediate transfer member disposed to face the image carriers so that each toner image formed on the image carriers are transferred and overlaid to form an color image. The surface of the image carrier being scanned and exposed in a main scanning direction with a light beam generated by the exposure member emitted through a light emitting window whose longitudinal direction is the main scanning direction. This image forming apparatus further includes a window cleaning device, a controller, and a density detecting member. The window cleaning device includes a cleaning member which is moved in a reciprocating manner in the main scanning direction along the light emitting window so as to perform a cleaning operation in which the cleaning member cleans the light emitting window. The controller controls operations of the image forming portion and drives the window cleaning device to perform the cleaning operation at a predetermined time. The density detecting member is capable of detecting image density of a stripe image formed by the image forming portion in a predetermined position on the intermediate transfer member continuously in a vertical scanning direction perpendicular to the main scanning direction. Further, the controller controls the exposure members to emit the light beam through the light emitting window so that the stripe image is formed at the predetermined position when the window cleaning device performs the cleaning operation, so as to form a image defect part on the stripe image, which occurs when the light beam is intercepted by the cleaning member moving along the light emitting window in the main scanning direction, and detects the image defect part by the density detecting member. The controller determines that the cleaning member stays within a scanning range of the light beam on the light emitting window when a predetermined number of the image defect parts are not formed in the predetermined position in a period from start to end of the cleaning operation.

DETAILED DESCRIPTION

An image forming apparatus according to an embodiment of the present disclosure is described with reference to an example of a color laser printer.

(Overall Structure of Image Forming Apparatus)

Figure 1:
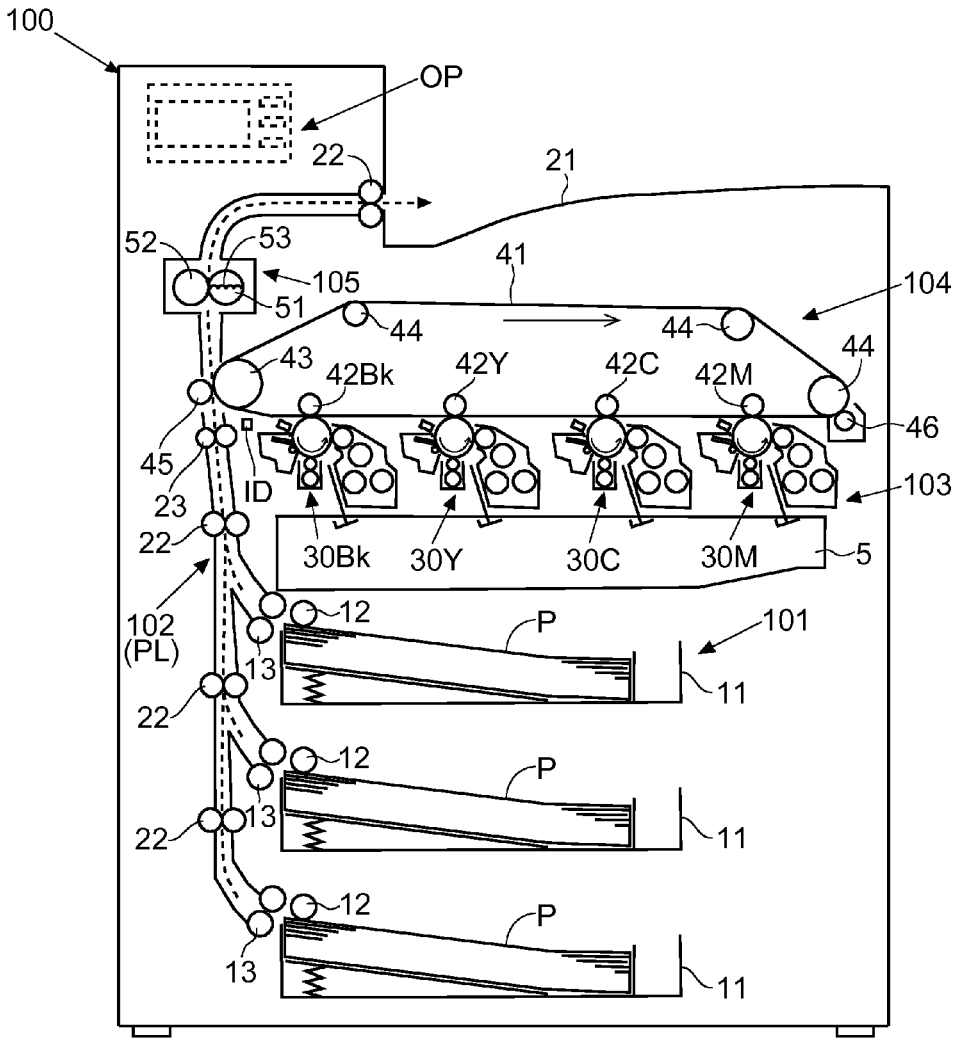
FIG. 1 is an overall structural diagram of an image forming apparatus according to an embodiment of the present disclosure.

As illustrated in FIG. 1, an image forming apparatus 100 of this embodiment includes a paper sheet feeder 101, a paper sheet conveying portion 102, an image forming portion 103, an intermediate transfer portion 104, and a fixing portion 105.

The paper sheet feeder 101 includes a cassette 11 for storing paper sheets P. Further, when the printing job (image formation process) is started, the paper sheet feeder 101 feeds the paper sheet P in the cassette 11 to a paper sheet transport path PL of the paper sheet conveying portion 102. The paper sheet feeder 101 is equipped with a pickup roller 12 for pulling out the paper sheets P in the cassette 11 one by one. In addition, the paper sheet feeder 101 is equipped with a roller pair 13 for supplying the paper sheet P to the paper sheet transport path PL while preventing multi feed of the paper sheets P pulled out from the cassette 11. The roller pair 13 is constituted of a paper feed roller and a separation roller.

The paper sheet conveying portion 102 conveys the paper sheet P along the paper sheet transport path PL and guides the same to an intermediate transfer portion 104 and the fixing portion 105, and finally to a sheet discharge tray 21. The paper sheet conveying portion 102 includes a plurality of conveying roller pairs 22 disposed in a rotatable manner in the paper sheet transport path PL. In addition, in the paper sheet conveying portion 102, there is also disposed a registration roller pair 23 for holding the paper sheet P that is being conveyed to wait before the intermediate transfer portion 104 and for sending out the same to the intermediate transfer portion 104 in synchronization with timing.

The image forming portion 103 includes toner image forming portions 30 of four colors (a toner image forming portion 30Bk for forming a black toner image, a toner image forming portion 30Y for forming a yellow toner image, a toner image forming portion 30C for forming a cyan toner image, and a toner image forming portion 30M for forming a magenta toner image), and exposure devices 5 for exposing outer circumference surfaces of individual photoreceptor drums 1 described later (for forming electrostatic latent images on the outer circumference surfaces of the individual photoreceptor drums 1). Note that the toner image forming portions 30Bk, 30Y, 30C and 30M, which form different color toner images, have basically the same structure. Therefore, in the following description, the symbols (Bk, Y, C and M) indicating individual colors are omitted.

Figure 2:
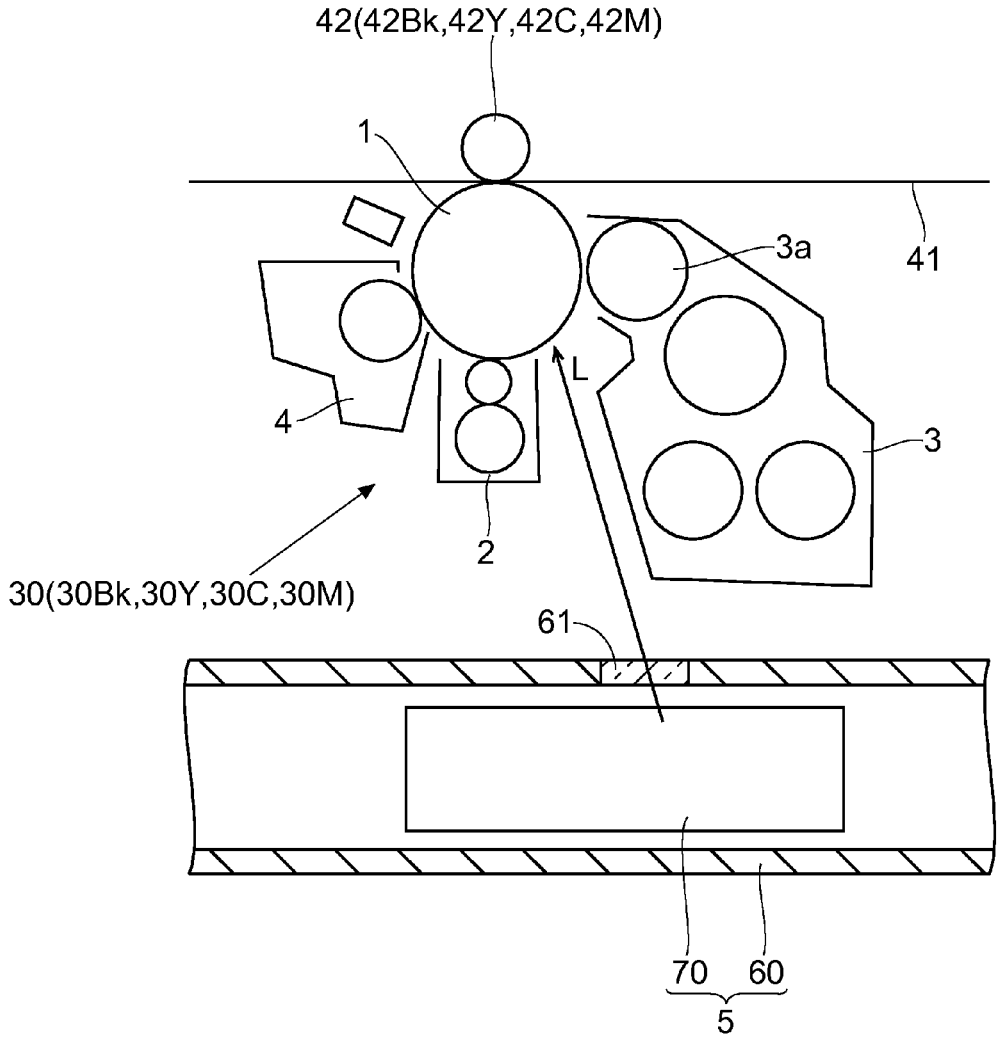
FIG. 2 is a schematic diagram of an image forming portion of the image forming apparatus illustrated in FIG. 1.

As illustrated in FIG. 2, the toner image forming portion 30 of each color includes the photoreceptor drum 1 (corresponding to the "image carrier" of the present disclosure), an electrification member 2, a developing unit 3 and a drum cleaning portion 4. Each photoreceptor drum 1 bears a toner image on the outer circumference surface and is supported in a rotatable manner in a circumferential direction. Each electrification member 2 charges the corresponding photoreceptor drum 1 at a constant potential. Each developing unit 3 stores developer of the corresponding color and supplied the toner to the outer circumference surface of the corresponding photoreceptor drum 1 (electrostatic latent image). Each drum cleaning portion 4 cleans the outer circumference surface of the corresponding photoreceptor drum 1.

The exposure device 5 includes a casing 60, and an exposure member 70 housed in the casing 60 so as to generate an exposing light beam L. The casing 60 is provided with a substantially rectangular opening for emitting the light beam L, whose longitudinal direction is a main scanning direction. This opening of the casing 60 is closed with a light emitting window 61 made of a light transmitting plate member for preventing dust (such as the toner) from entering into the casing 60. In other words, the light emitting window 61 has a substantially rectangular shape whose longitudinal direction is the main scanning direction. Further, the exposure member 70 generates the light beam L, which is emitted from the light emitting window 61 and exposes the outer circumference surface of the photoreceptor drum 1 by scanning in the main scanning direction so as to form an electrostatic latent image on the outer circumference surface of the photoreceptor drum 1. Note that the opening of the casing 60 for emitting the light beam is formed for each color, and each opening of the casing 60 has the light emitting window 61.

Figure 3:
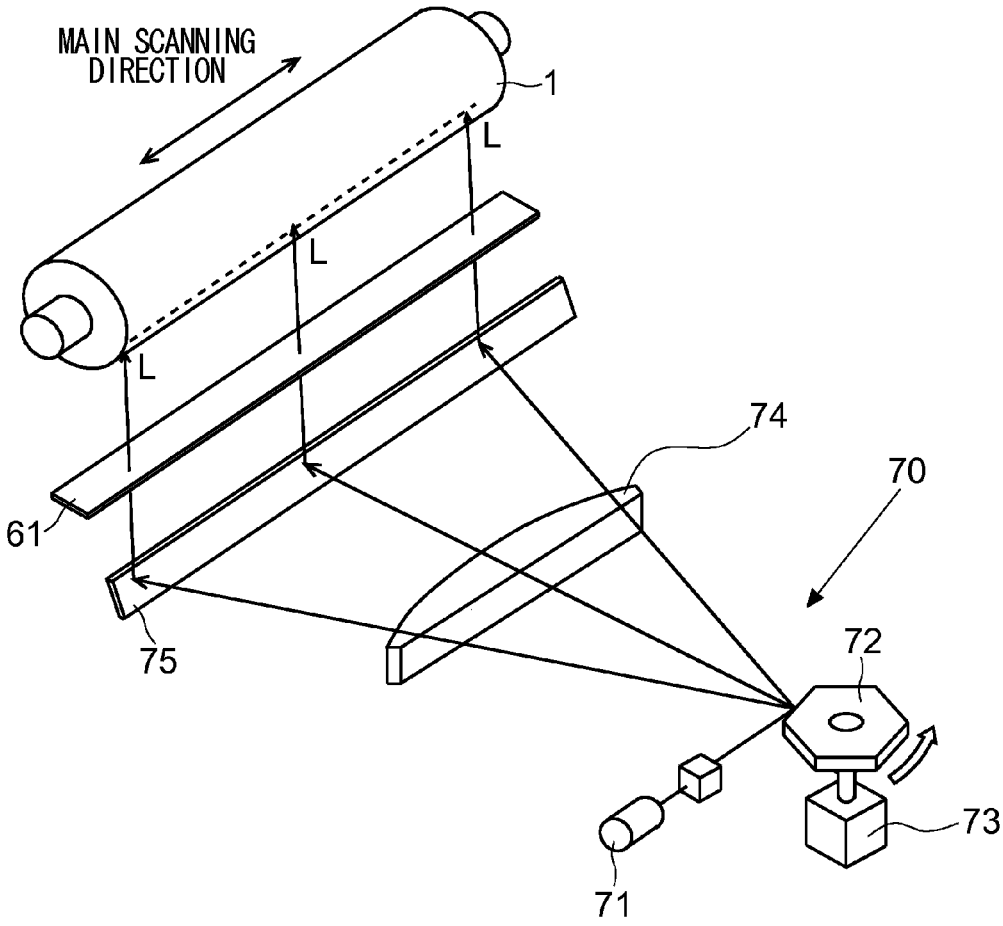
FIG. 3 is a schematic diagram of an exposure device (exposure unit) incorporated in the image forming apparatus illustrated in FIG. 1.

As illustrated in FIG. 3, the exposure member 70 includes a semiconductor laser element 71, a polygon mirror 72, a polygon motor 73, an Fθ lens 74, a reflection mirror 75 and the like. For instance, a set of the structural members (71 to 75) of the exposure member 70 illustrated in FIG. 3 is disposed for each color.

The semiconductor laser element 71 generates the exposing light beam L. When the semiconductor laser element 71 emits the light beam L, the light beam L enters a mirror surface (side surface) of the polygon mirror 72. In this case, the polygon mirror 72 is rotated by drive force transmitted from the polygon motor 73. Therefore, the light beam L entering the polygon mirror 72 is reflected and deflected by the polygon mirror 72. In other words, the polygon mirror 72 deflects the light beam L for scanning in the main scanning direction. After that, the light beam L enters the Fθ lens 74. The Fθ lens 74 guides the light beam L to the reflection mirror 75 so that the light beam L scans in the main scanning direction at constant speed. The reflection mirror 75 reflects the light beam L toward the light emitting window 61 (photoreceptor drum 1). In this way, the light beam L is emitted from the light emitting window 61 so that the outer circumference surface of the photoreceptor drum 1 is exposed.

Here, if the light emitting window 61 is contaminated, intensity of the light beam L reaching the photoreceptor drum 1 is decreased, or the light beam L is reflected diffusely. In this case, exposure of the photoreceptor drum 1 is badly affected so that image quality is deteriorated. Therefore, the exposure device 5 is equipped with a window cleaning device 8 (see FIG. 4) for cleaning the light emitting window 61.

Figure 4:
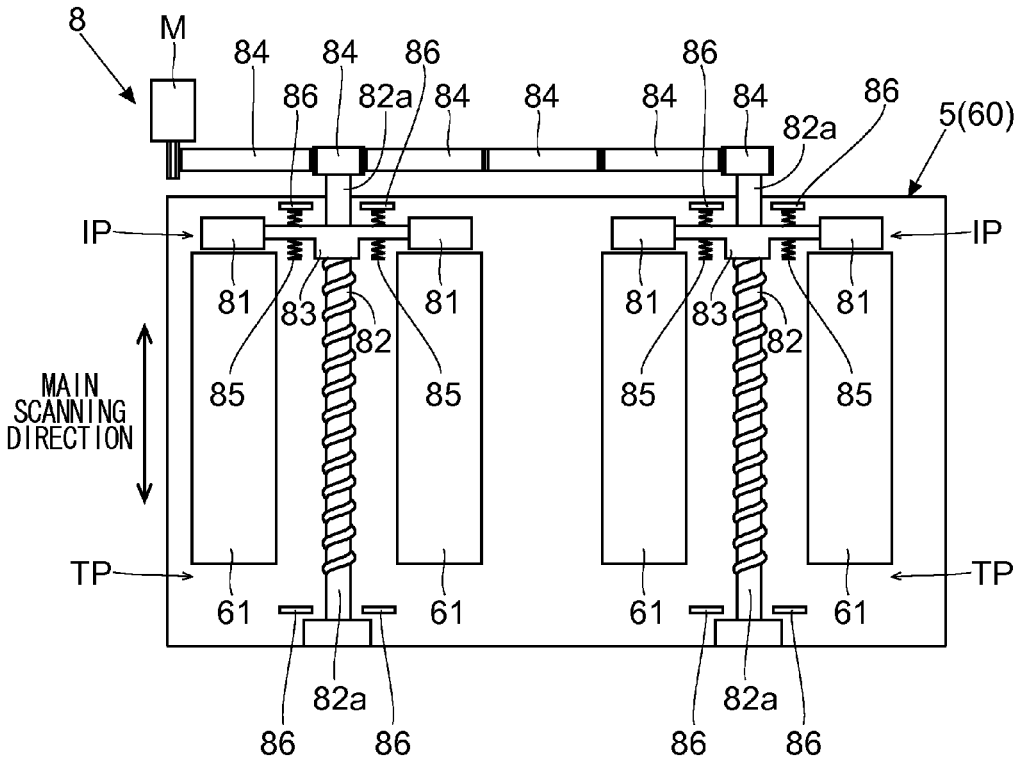
FIG. 4 is a schematic diagram of a window cleaning device provided in the image forming apparatus illustrated in FIG. 1.

As illustrated in FIG. 4, the window cleaning device 8 includes a cleaning member 81, a screw shaft 82, a sliding member 83, a gear 84, a cleaning motor M (corresponding to the "driving portion" of the present disclosure) and the like. The cleaning member 81 is made of a material that can clean without hurting a surface of the light emitting window 61 (nonwoven fabric such as felt, a resin blade or the like). One cleaning member 81 is disposed for each light emitting window 61.

One screw shaft 82 is prepared for two light emitting windows 61 and is disposed between the corresponding two light emitting windows 61 so as to extend in the main scanning direction. The sliding member 83 is engaged with each screw shaft 82 one to one. When the screw shaft 82 rotates, the sliding member 83 is moved in the main scanning direction. In addition, each sliding member 83 holds two cleaning members 81. When the sliding member 83 is moved in the main scanning direction, the cleaning member 81 contacting with the surface of the light emitting window 61 is moved in the main scanning direction so that the light emitting window 61 is cleaned by the cleaning member 81.

In addition, the screw shaft 82 is linked to the cleaning motor M via the gear 84. In other words, the drive force of the cleaning motor M is transmitted to the screw shaft 82. The cleaning motor M can rotates in forward and reverse directions. In this way, the cleaning member 81 (sliding member 83) can be moved in a reciprocating manner along the main scanning direction.

With reference to FIG. 1 again, the intermediate transfer portion 104 includes an endless intermediate transfer belt 41 (corresponding to the "intermediate transfer member" of the present disclosure) and primary transfer rollers 42 (42Bk, 42Y, 42C and 42M) allotted to the individual toner image forming portions 30, respectively. The intermediate transfer belt 41 is sandwiched between each of the primary transfer rollers 42Bk, 42Y, 42C and 42M and the corresponding toner image forming portion 30 (specifically, the photoreceptor drum 1), and a primary transfer voltage is applied to the primary transfer rollers 42Bk, 42Y, 42C and 42M.

In addition, the intermediate transfer portion 104 also includes a drive roller 43 and follower rollers 44. The intermediate transfer belt 41 is stretched around the drive roller 43 and the follower rollers 44, as well as the primary transfer rollers 42Bk, 42Y, 42C and 42M. Then, the intermediate transfer belt 41 is driven to turn around in the direction perpendicular to the main scanning direction when the drive roller 43 rotates.

In addition, the intermediate transfer portion 104 further includes a secondary transfer roller 45. The intermediate transfer belt 41 is sandwiched between the secondary transfer roller 45 and the drive roller 43, and a secondary transfer voltage is applied to the secondary transfer roller 45.

Further, the toner images formed by the individual toner image forming portions 30 (toner images born by the photoreceptor drums 1) are sequentially transferred primarily and overlaid without misregistration onto the intermediate transfer belt 41 by the primary transfer rollers 42Bk, 42Y, 42C and 42M to which the primary transfer voltages are applied. In other words, the intermediate transfer belt 41 undergoes transfer of the toner images from the individual photoreceptor drums 1. In this way, a color image is formed on the intermediate transfer belt 41. After that, the toner image (color image) that is primarily transferred onto the intermediate transfer belt 41 is secondarily transferred onto the paper sheet P by the secondary transfer roller 45 applied with the secondary transfer voltage.

In addition, the intermediate transfer portion 104 further includes a belt cleaning device 46. The belt cleaning device 46 cleans the intermediate transfer belt 41 after the secondary transfer of the toner image from the intermediate transfer belt 41 to the paper sheet P.

Note that a density detection sensor ID (corresponding to the "density detecting member" of the present disclosure) is disposed near the intermediate transfer belt 41 so as to face a part of the intermediate transfer belt 41. The density detection sensor ID is a reflection type optical sensor and emits light toward a surface of the intermediate transfer belt 41 so as to deliver an output whose level changes in accordance with light intensity of reflection light from the surface of the intermediate transfer belt 41. For instance, two density detection sensors ID are disposed. In case of disposing two density detection sensors ID, they are disposed with a predetermined interval on the same line in the main scanning direction.

The fixing portion 105 heats and presses the toner image transferred onto the paper sheet P so as to fix the toner image. The fixing portion 105 includes a heating roller 51 and a pressing roller 52. A heater 53 is embedded in the heating roller 51. The pressing roller 52 is pressed to the heating roller 51. Then, the paper sheet P with the transferred toner image passes through a fixing nip formed between the heating roller 51 and the pressing roller 52 so as to be heated and pressed. In this way, the toner image is fixed to the paper sheet P, and the printing process is completed. After that, the paper sheet P after the printing is sent to the sheet discharge tray 21.

In addition, the image forming apparatus 100 is equipped with an operation panel OP. This operation panel OP includes a liquid crystal display portion with a touch panel, for example, which displays messages indicating statuses of the apparatus and soft keys for accepting various inputs. In addition, the operation panel OP also includes hardware keys such as a ten key and a start key. For instance, the operation panel OP accepts a start instruction of a cleaning operation described later.

(Hardware Structure of Image Forming Apparatus)

Figure 5:
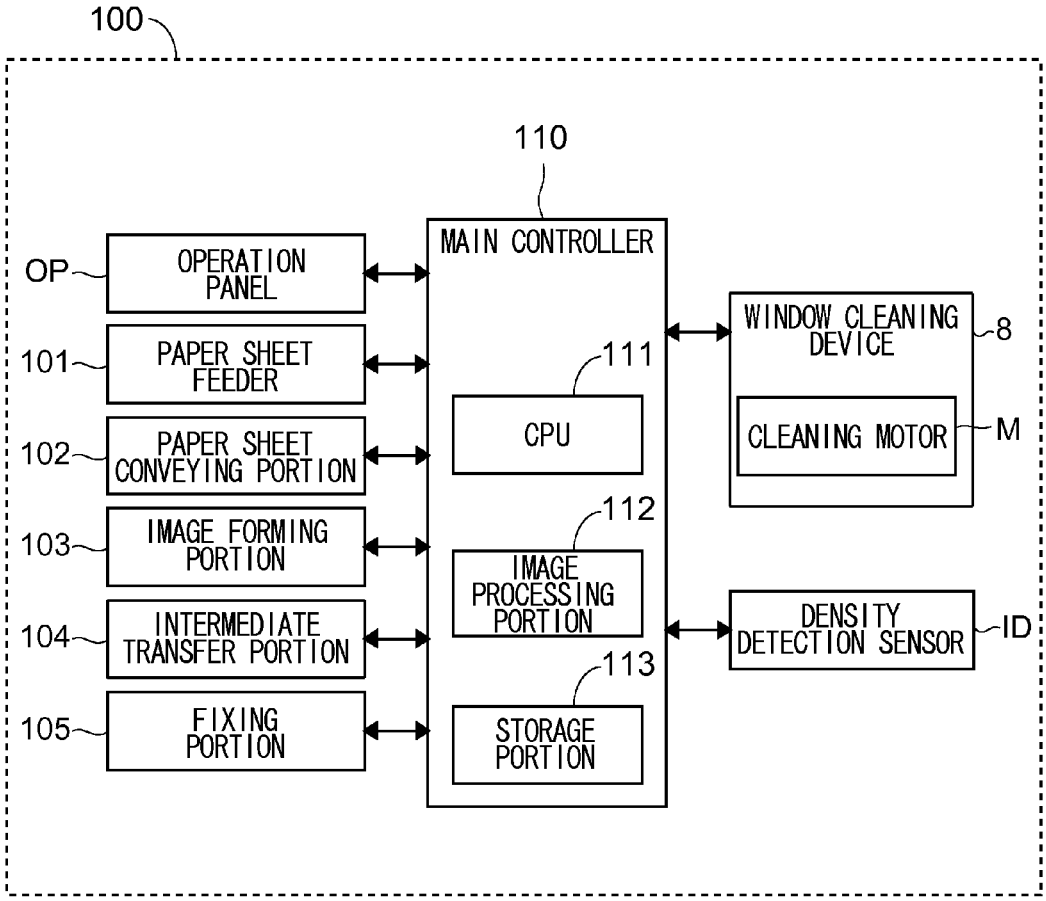
FIG. 5 is a block diagram for explaining hardware structure of the image forming apparatus illustrated in FIG. 1.

As illustrated in FIG. 5, the image forming apparatus 100 includes a main controller 110. The main controller 110 includes a CPU 111, an image processing portion 112 and a storage portion 113.

The image processing portion 112 is constituted of an ASIC dedicated to image processing, a memory and the like, and performs various image processings (enlargement/reduction, density conversion, data format conversion and the like) on image data. The storage portion 113 is constituted of a ROM, a RAM, an HDD and the like. For instance, program and data necessary for executing jobs are stored in the ROM, and the programs and the data are loaded to the RAM.

In addition, the main controller 110 is connected to the paper sheet feeder 101, the paper sheet conveying portion 102, the image forming portion 103 (the photoreceptor drum 1, the electrification member 2, the developing unit 3, the drum cleaning portion 4 and the exposure device 5), the intermediate transfer portion 104, the fixing portion 105 and the operation panel OP. Further, the main controller 110 controls individual portions of the image forming apparatus 100 in accordance with programs and data stored in the storage portion 113.

Figure 6:
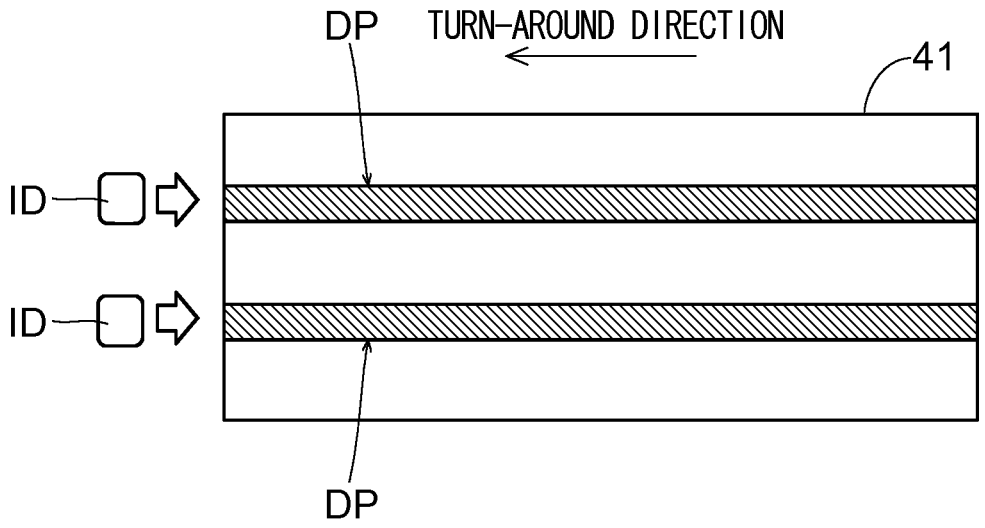
FIG. 6 is a diagram for explaining a density detecting position of an intermediate transfer member of the image forming apparatus illustrated in FIG. 1.

In addition, the main controller 110 receives an output of the density detection sensor ID. Then, the main controller 110 detects density of toner adhered to a density detecting position DP (see FIG. 6) of the intermediate transfer belt 41 on the basis of the output of the density detection sensor ID. Note that the density detecting position DP is a position on the intermediate transfer belt 41 facing the density detection sensor ID when the intermediate transfer belt 41 turns around (a hatched area in FIG. 6), and corresponds to the "predetermined position" of the present disclosure.

For instance, the main controller 110 performs image density calibration or the like on the basis of the output of the density detection sensor ID. When the main controller 110 performs the image density calibration, the main controller 110 makes a patch toner image for density adjustment transferred to the density detecting position DP of the intermediate transfer belt 41 while the intermediate transfer belt 41 turns around. Then, the main controller 110 detects image density of the patch toner image (hereinafter referred to simply as patch density) on the basis of the output of the density detection sensor ID. Further, prior to detection of the patch density, the main controller 110 detects image density (hereinafter referred to simply as surface density) when the patch toner image is not transferred to the density detecting position DP of the intermediate transfer belt 41 (position to which the patch toner image should be transferred) on the basis of the output of the density detection sensor ID. Next, the main controller 110 calculates a value obtained by subtracting a surface density value from a patch density value as a patch density value before correction (i.e., an influence of light reflection by the surface of the intermediate transfer belt 41 is removed from the patch density value). After that, the main controller 110 adjusts a voltage applied to a developing roller 3*a* (a structural member of the developing device 3 illustrated in FIG. 2) on the basis of the patch density value before correction.

(Cleaning Operation of Light Emitting Window)

As illustrated in FIG. 5, the main controller 110 is connected to the window cleaning device 8. Then, the main controller 110 drives the window cleaning device 8 at predetermined time so that the window cleaning device 8 performs the cleaning operation (cleaning operation of the light emitting window 61). For instance, when the operation panel OP accepts the start instruction of the cleaning operation, the main controller 110 controls the window cleaning device 8 to perform the cleaning operation. Alternatively, when the number of printed sheets reaches a predetermined value (e.g. a few hundreds to a few thousands), the main controller 110 controls the window cleaning device 8 to perform the cleaning operation. The details of the cleaning operation are described below.

Figure 7A:
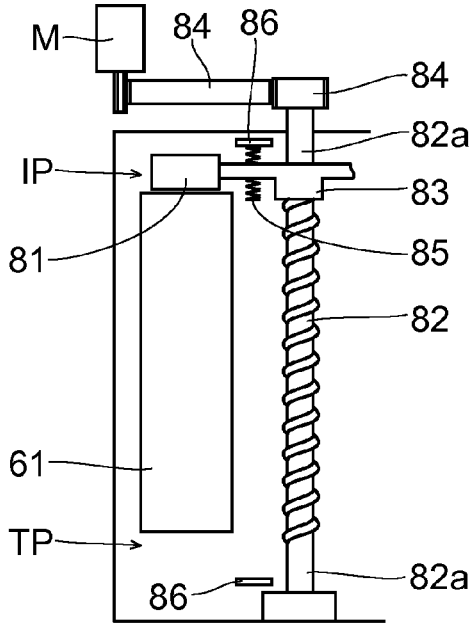
FIG. 7A is a diagram for explaining a cleaning operation of a light emitting window performed by the window cleaning device illustrated in FIG. 4.
Figure 7B:
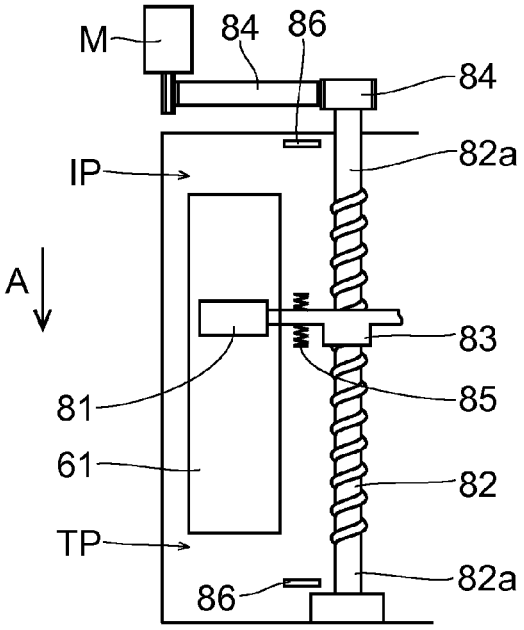
FIG. 7B is a diagram for explaining the cleaning operation of the light emitting window performed by the window cleaning device illustrated in FIG. 4.

First, when the main controller 110 does not control the window cleaning device 8 to perform the cleaning operation, the main controller 110 controls the cleaning member 81 (sliding member 83) to stand by at an initial position IP as illustrated in FIG. 7A. The initial position IP is one end position of the light emitting window 61 in the main scanning direction and is a position outside the scanning range of the exposing light beam L. Further, when the main controller 110 starts the cleaning operation, the main controller 110 rotates the cleaning motor M in the forward direction. In this way, as illustrated in FIG. 7B, the cleaning member 81 moves toward a turn position TP (moves in arrow A direction in the diagram) while contacting with the surface of the light emitting window 61. The turn position TP is the other end position of the light emitting window 61 in the main scanning direction and is a position outside the scanning range of the exposing light beam L.

Figure 8A:
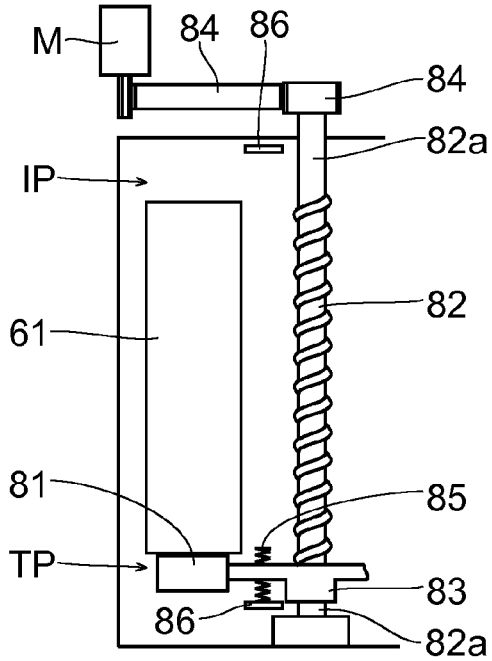
FIG. 8A is a diagram for explaining the cleaning operation of the light emitting window performed by the window cleaning device illustrated in FIG. 4.

After starting the cleaning operation, the main controller 110 rotates the cleaning motor M in the forward direction continuously until the cleaning member 81 reaches the turn position TP. In this way, as illustrated in FIG. 8A, the cleaning member 81 reaches the turn position TP.

Figure 8B:
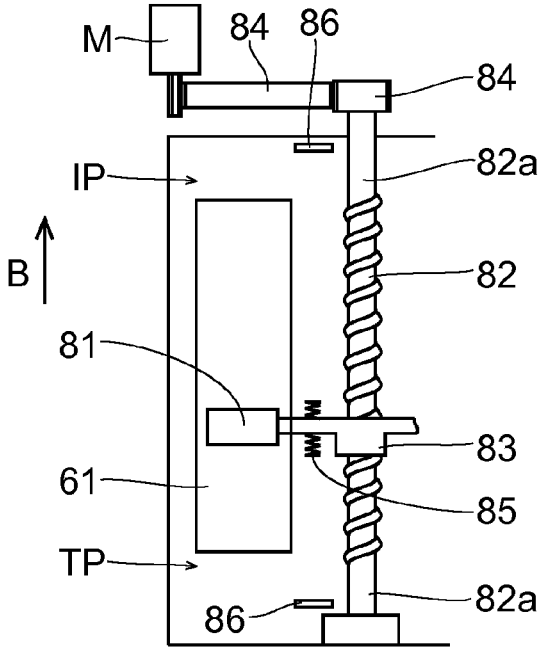
FIG. 8B is a diagram for explaining the cleaning operation of the light emitting window performed by the window cleaning device illustrated in FIG. 4.

When the cleaning member 81 reaches the turn position TP, the main controller 110 rotates the cleaning motor M in the reverse direction. In this way, the cleaning member 81 moves toward the initial position IP as illustrated in FIG. 8B (in arrow B direction in the diagram).

In this way, the window cleaning device 8 cleans the light emitting window 61 by performing the cleaning operation in which the cleaning member 81 is moved in one reciprocation from the initial position IP along a predetermined path (from the initial position IP via the turn position TP to the initial position IP). In the following description, the movement path of the cleaning member 81 in the cleaning operation may be referred to as a cleaning path.

Here, on both ends of the screw shaft 82, there are formed threadless parts 82*a* in which a screw thread is missing. In addition, coil springs 85 are attached to the sliding member 83. Further, abutting members 86 to which the coil springs 85 abut are disposed near the both ends of the screw shaft 82. With this structure, when the screw shaft 82 rotates by the drive force of the cleaning motor M so that the sliding member 83 is sent to an end of the screw shaft 82, the coil springs 85 abut the abutting member 86 and are compressed. After that, when the sliding member 83 reaches the threadless part 82*a* of the screw shaft 82, engagement between the screw shaft 82 and the sliding member 83 is released (the screw shaft 82 rotates in vain). However, the sliding member 83 is pressed back by restoring force of the coil spring 85, and the screw shaft 82 is engaged with the sliding member 83 again. In this case, if the screw shaft 82 is rotating in the same direction, the engagement between the screw shaft 82 and the sliding member 83 is released again, and the above-mentioned action is repeated. In this way, because the cleaning member 81 held by the sliding member 83 is vibrated, toner and the like adhered to the cleaning member 81 are shaken off.

(Position Detection of Cleaning Member)

When the cleaning operation is being performed, if a foreign object is pinched between the screw shaft 82 and the sliding member 83, movement speed of the cleaning member 81 in the main scanning direction may be decreased, or the movement of the cleaning member 81 is stopped. Therefore, the cleaning operation may finish before the cleaning member 81 returns to the initial position IP, and hence the cleaning member 81 may stop at a point in the cleaning path (from the initial position IP via the turn position TP to the initial position IP). For instance, there is a case where the cleaning member 81 stays at a position illustrated in FIG. 7B or FIG. 8B. In other words, an error occurs in the cleaning operation. Then, when the image formation process (including the exposing process by the exposure device 5) is performed in the state where the cleaning member 81 is at a point in the cleaning path, the light beam L emitted from the exposure device 5 is blocked by the cleaning member 81 in the exposing process of the photoreceptor drum 1, and hence a position of the photoreceptor drum 1 corresponding to the position where the cleaning member 81 stays is not exposed. In other words, the toner does not adhere to a position of the intermediate transfer belt 41 corresponding to the position where the cleaning member 81 stays. As a result, quality of the printed image is deteriorated (for example, a white line appears in the main scanning direction).

Therefore, when the main controller 110 controls the window cleaning device 8 to perform the cleaning operation, the main controller 110 controls the light emitting window 61 to emit a light beam for forming a stripe image. Thus, a image defect part NP, which occurs when the cleaning member 81 moving in a reciprocating manner in the main scanning direction along the light emitting window 61 blocks the light beam (see FIG. 10 or FIG. 12), is formed in the stripe image. Note that the stripe image is formed by the image forming portion 103 in the density detecting position DP of the intermediate transfer belt 41 and is formed continuously in the vertical scanning direction perpendicular to the main scanning direction. In addition, the main controller 110 detects the image defect part NP on the basis of the output of the density detection sensor ID. Then, when a predetermined number of image defect parts NP are not formed in the density detecting position DP in a period from start to end of the cleaning operation, the main controller 110 determines that the cleaning member 81 stays within the scanning range of the light beam (determines that an error has occurred in the cleaning operation).

Figure 9:
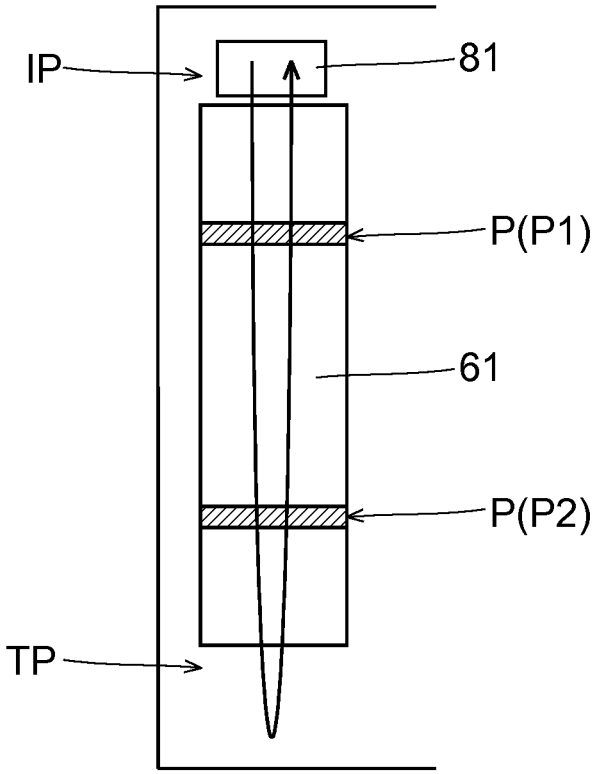
FIG. 9 is a diagram illustrating an example of a movement locus of the cleaning member of the window cleaning device illustrated in FIG. 4.

Here, because the two density detection sensors ID are disposed with a predetermined interval in the main scanning direction (see FIG. 6), two positions P of the light emitting windows 61 correspond to the density detecting positions DP as illustrated in FIG. 9 (behaviors of the light beams L emitted from the two positions P of the light emitting windows 61 affect toner density of the density detecting positions DP). In the following description, one of the positions P may be referred to as a first position P1 while the other position P may be referred to as a second position P2.

Figure 10:
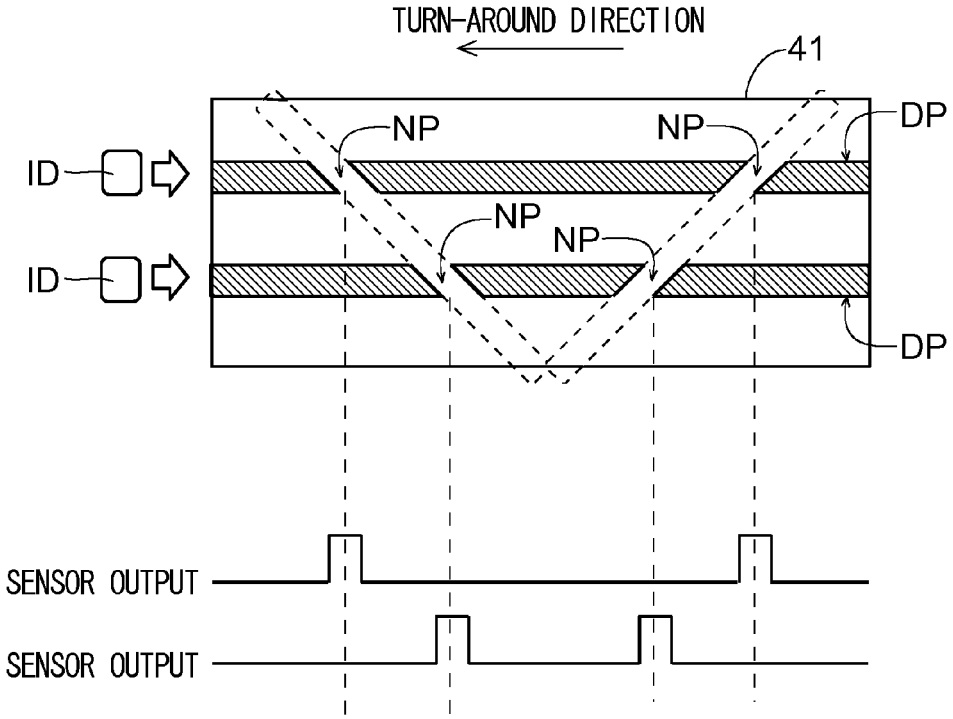
FIG. 10 is a diagram for explaining an output variation of the density detection sensor (the number of the image defect parts) when the cleaning member moves along the locus illustrated in FIG. 9.

In this case, if the cleaning member 81 moves normally along the cleaning path from the initial position IP via the turn position TP to the initial position IP, the cleaning member 81 passes through the position P of the light emitting window 61 four times in total (passes through the first position P1, the second position P2, the second position P2, and the first position P1 in this order). Therefore, the light beam L emitted from the exposure device 5 is blocked by the cleaning member 81 four times in total. Therefore, as illustrated in FIG. 10, the image defect parts NP of total four positions appear in the density detecting position DP. In other words, output values of two density detection sensors DS indicate that there is no toner two times each.

Figure 11:
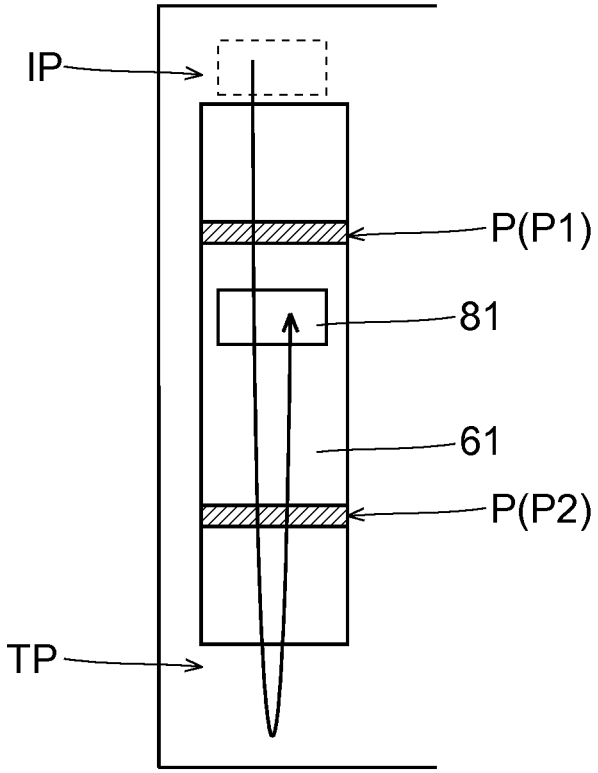
FIG. 11 is a diagram illustrating an example of a movement locus of the cleaning member of the window cleaning device illustrated in FIG. 4.
Figure 12:
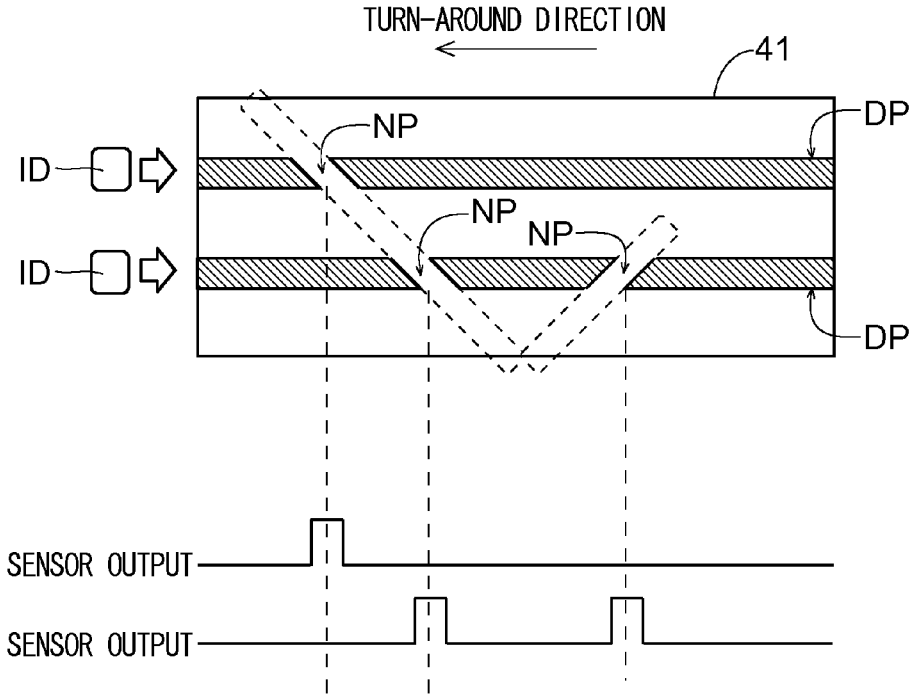
FIG. 12 is a diagram for explaining an output variation of the density detection sensor (the number of the image defect parts) when the cleaning member moves along the locus illustrated in FIG. 11.

On the other hand, it is supposed as illustrated in FIG. 11, for example, that the cleaning operation is finished before the cleaning member 81 reaches the first position P1 after moving from the initial position IP and passing through the second position P2 via the turn position TP. In this case, the cleaning member 81 passes through the position P of the light emitting window 61 three times in total. Therefore, as illustrated in FIG. 12, the image defect part NP appears only in three positions in total in the density detecting position DP. In other words, an output of one of the two density detection sensors DS becomes a value indicating there is no toner two times, while an output of the other density detection sensor DS becomes a value indicating there is no toner only once.

Therefore, when the number of detection times of the image defect part NP has reached an estimated number of passing times for the cleaning member 81 to pass through the position P of the light emitting window 61 in the cleaning operation, the main controller 110 determines that the cleaning member 81 has returned to the initial position IP. When the number of detection times of the image defect part NP has not reached the above-mentioned estimated number of passing times, the main controller 110 determines that the cleaning member 81 has not returned to the initial position IP. In other words, the main controller 110 determines whether or not the number of detection times of the image defect part NP has reached the threshold number of times that is the above-mentioned estimated number of passing times (whether or not the output values of the density detection sensors DS indicate that there is no toner two times each), so as to determine whether or not the cleaning member 81 has returned to the initial position IP. Further, in other words, when the image defect parts NP of the number corresponding to the threshold number of times (a predetermined number) are formed in the density detecting position DP in the period from start to end of the cleaning operation, the main controller 110 determines that the cleaning member 81 has returned to the initial position IP. When the image defect parts NP of the number corresponding to the threshold number of times (a predetermined number) are not formed in the density detecting position DP, the main controller 110 determines that the cleaning member 81 has not returned to the initial position IP.

For instance, in the example illustrated in FIG. 9 and FIG. 10, the output values of the two density detection sensors DS indicate that there is no toner two times each, and the number of detection times of the image defect part NP reaches the threshold number of times. Therefore, it is determined that the cleaning member 81 has returned to the initial position IP. In the example illustrated in FIG. 11 and FIG. 12, one of output values of the two density detection sensors DS indicates that there is no toner two times, but the other output value of the density detection sensor DS indicates that there is no toner only once. In other words, because the number of detection times of the image defect part NP does not reach the threshold number of times, it is determined that the cleaning member 81 has not returned to the initial position IP.

(Retry Operation)

When the main controller 110 determines that the cleaning member 81 has not returned to the initial position IP (determines that an error has occurred in the cleaning operation), the main controller 110 controls the window cleaning device 8 to perform a retry operation after the cleaning operation, in which the cleaning member 81 is moved to the initial position IP outside the scanning range of the exposing light beam L. Specifically, the main controller 110 determines whether the cleaning member 81 has stopped in an outward way (from the initial position IP to the turn position TP) or in a home way (from the turn position TP to the initial position IP) on the basis of the number of detection times of the image defect part NP when the cleaning operation finishes. When the main controller 110 determines that the cleaning member 81 has stopped in the outward way, the main controller 110 controls the cleaning motor M to rotate forward and then backward (so that the cleaning member 81 moves to the turn position TP and then returns to the initial position IP) when the retry operation is started. On the contrary, when the main controller 110 determines that the cleaning member 81 has stopped in the home way, the main controller 110 controls the cleaning motor M to rotate backward without rotating forward (so that the cleaning member 81 returns directly to the initial position IP from the current position) when the retry operation is started.

Here, when the retry operation is performed, the main controller 110 controls to emit the light beam from the light emitting window 61 to form the stripe image, and detects the image defect part NP on the basis of the output of the density detection sensor ID. Then, the main controller 110 determines whether or not the cleaning member 81 has returned to the initial position IP on the basis of the number of detection times of the image defect part NP.

For instance, as illustrated in FIG. 11 and FIG. 12, it is supposed that the cleaning operation is finished before the cleaning member 81 reaches the first position P1 after moving from the initial position IP via the turn position TP to pass through the second position P2. In other words, it is supposed that the output values of the two density detection sensors DS do not indicate that there is no toner two times each (it is supposed that the number of detection times of the image defect part NP detected by the main controller 110 has not reached to the threshold number of times). In this case, the main controller 110 drives the cleaning motor M again (performs the retry operation).

When the retry operation is performed so that the sliding member 83 is moved normally by the screw shaft 82, the cleaning member 81 returns to the initial position IP. In this way, if the cleaning member 81 returns to the initial position IP, the total number of the number of detection times of the image defect part NP after the cleaning operation detected by the main controller 110 and the number of detection times of the image defect part NP after the retry operation reaches the threshold number of times.

Therefore, the main controller 110 controls the window cleaning device 8 to perform the retry operation. Then, when the total number of detection times with the image defect part NP reaches the threshold number of times, the main controller 110 controls the window cleaning device 8 to finish the retry operation. For instance, the main controller 110 stores the number of detection times of the image defect part NP, and adds the number of detection times of the image defect part NP after the retry operation to the number of detection times of the image defect part NP stored before every time when the retry operation is performed. Note that there is a case where the cleaning member 81 does not return to the initial position IP by only one retry operation by the window cleaning device 8. Therefore, when the total number of detection times of the image defect part NP does not reach the threshold number of times, the main controller 110 controls the window cleaning device 8 to repeat the retry operation.

However, even if the retry operation is repeated, there is a case where the total number of detection times of the image defect part NP detected by the main controller 110 does not reach the threshold number of times. In this case, there may occur a problem such as that the cleaning member 81 (sliding member 83) is caught by a certain member and cannot move, or that a foreign object is tightly pinched between the screw shaft 82 and the sliding member 83, or that a drive mechanism for moving the cleaning member 81 is broken in itself. Further, if the retry operation is tried continuously in this inconvenient situation, a load on the gear 84 or on the cleaning motor M is increased resulting in shortening of life of the gear 84 or the cleaning motor M. Therefore, the main controller 110 controls the window cleaning device 8 to perform the retry operation a predetermined number of times (e.g. two to five times), and when the total number of detection times of the image defect part NP does not reach the threshold number of times as a result, the retry operation by the window cleaning device 8 is finished.

Figure 13:
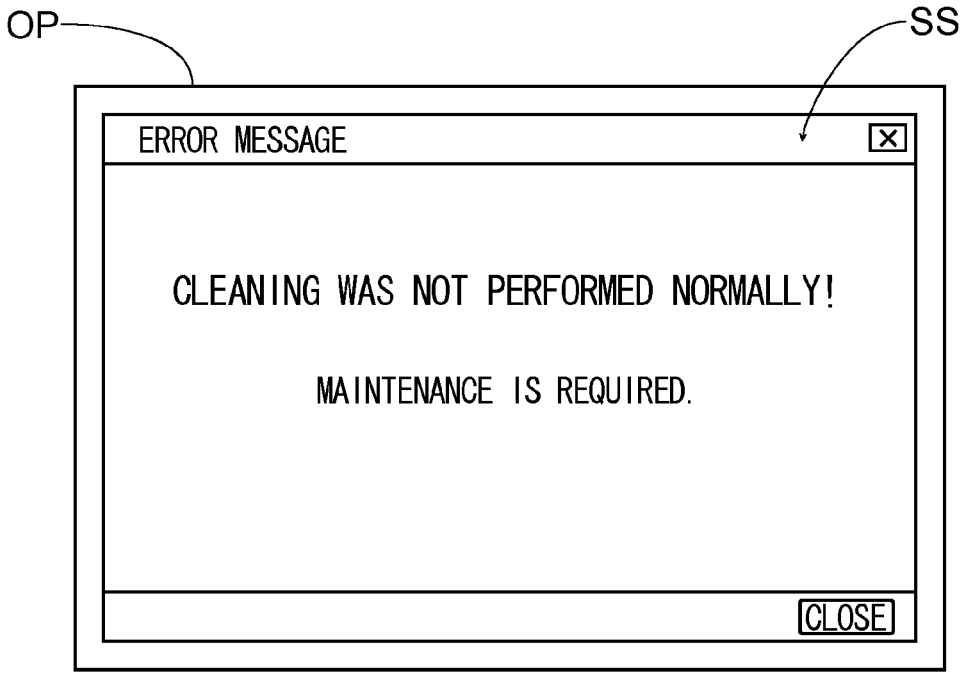
FIG. 13 is a diagram illustrating an example of a screen that is displayed when the cleaning operation is not normally performed in the image forming apparatus illustrated in FIG. 1.

Then, when the total number of detection times of the image defect part NP does not reach the threshold number of times after performing the retry operation successively a predetermined number of times, the main controller 110 instructs the operation panel OP to notify that an error has occurred in the cleaning operation. For instance, the operation panel OP displays a notification screen SS as illustrated in FIG. 13. This notification screen SS includes a text message for notifying that an error has occurred in the cleaning operation, for example.

(Flow of Cleaning Operation)

A flow of the cleaning operation is described below with reference to a flowchart illustrated in FIG. 14.

Figure 14:
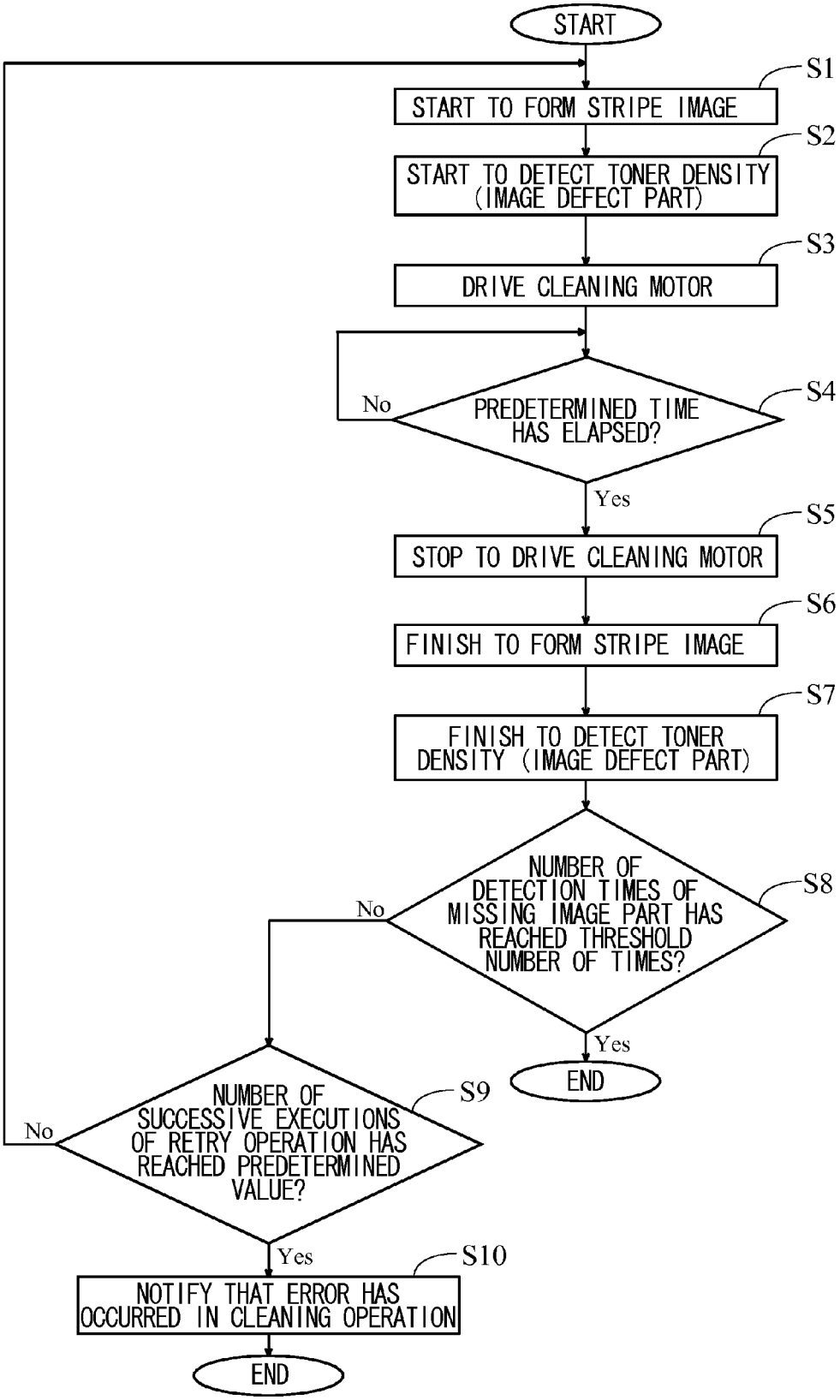
FIG. 14 is a flowchart for explaining a flow of the cleaning operation (retry operation) performed by the image forming apparatus illustrated in FIG. 1.

First, it is supposed that the cleaning member 81 stands by at the initial position IP at the start time point of the flowchart of FIG. 14. In other words, it is supposed that the cleaning operation of last time was normally finished (the cleaning member 81 has returned to the initial position IP by the retry operation). Then, the flowchart of FIG. 14 starts when the operation panel OP accepts the start instruction of the cleaning operation or when the number of printed sheets reaches a predetermined value.

In Step S1, the main controller 110 drives the image forming portion 103 to start the operation for forming the stripe image in the density detecting position DP of the intermediate transfer belt 41. In other words, the electrification member 2 charges the surface of the photoreceptor drum 61 at a predetermined potential. The exposure device 5 scans and exposes the surface of the photoreceptor drum 1. The developing unit 3 supplies toner to the electrostatic latent image so as to develop the image. In addition, in Step S2, the main controller 110 starts detection of the toner density of the density detecting position DP (image defect part NP) on the basis of the output of the density detection sensor ID. Then, in Step S3, the main controller 110 starts to drive the cleaning motor M. In other words, the main controller 110 controls the window cleaning device 8 to start the cleaning operation.

Next, in Step S4, the main controller 110 determines whether or not a predetermined time has lapsed from the start of the cleaning operation. Note that the predetermined time is an estimated time necessary for the cleaning member 81 to return to the initial position IP. As a result, when the predetermined time has elapsed, the process proceeds to Step S5 in which the main controller 110 stops to drive the cleaning motor M. Then, the process proceeds to Step S6. On the contrary, when the predetermined time has not elapsed, the determination of Step S4 is repeated (drive of the cleaning motor M is continued).

When the process proceeds from Step S5 to Step S6, the main controller 110 stops to drive the image forming portion 103 and finishes the operation for forming the stripe image in the density detecting position DP of the intermediate transfer belt 41. In addition, in Step S7, the main controller 110 finishes the detection of the toner density of the density detecting position DP (image defect part NP).

Then, in Step S8, the main controller 110 determines whether or not the number of detection times of the image defect part NP has reached the threshold number of times (the estimated number of passing times for the cleaning member 81 to pass through the position P of the light emitting window 61 corresponding to the density detecting position DP). As a result, when the number of detection times of the image defect part NP has reached the threshold number of times, the process is finished. On the contrary, when the number of detection times of the image defect part NP has not reached the threshold number of times, the process proceeds to Step S9.

In Step S9, the main controller 110 determines whether or not the number of successive executions of the retry operation has reached a predetermined value. As a result, when the number of successive executions of the retry operation has not reached the predetermined value, the process proceeds to Step S1.

On the contrary, in Step S9, when the number of successive executions of the retry operation has reached the predetermined value, the process proceeds to Step S10. In Step S10, the main controller 110 instructs the operation panel OP to display the notification screen SS as illustrated in FIG. 13 so as to notify that an error has occurred in the cleaning operation.

In this embodiment, with the structure described above, when the cleaning member 81 passes through the position P of the light emitting window 61 corresponding to the density detecting position DP, the cleaning member 81 blocks the light beam L, and the image defect part NP to which the toner does not adhere appears in the density detecting position DP. In other words, the image defect part NP appear in the density detecting position DP in accordance with the number of times when the cleaning member 81 passes through the position P of the light emitting window 61. Therefore, if the cleaning member 81 moves normally in the cleaning operation so that the cleaning member 81 passes through the position P of the light emitting window 61 as expected, the number of the image defect parts NP appearing in the density detecting position DP is the same as the estimated number of passing times for the cleaning member 81 to pass through the position P of the light emitting window 61 in the cleaning operation. On the contrary, if the cleaning member 81 stops and stays at a position in the cleaning operation for a certain reason (if the cleaning member 81 does not pass through the position P of the light emitting window 61 as expected), the number of the image defect part NP appearing in the density detecting position DP becomes smaller than the above-mentioned estimated number of passing times.

Therefore, when the main controller 110 controls the window cleaning device 8 to perform the cleaning operation, the main controller 110 controls to emit the light beam from the light emitting window 61 for forming the stripe image and detects the image defect part NP on the basis of the output of the density detection sensor ID. Then, when the predetermined number of image defect parts NP are not formed in the density detecting position DP in the period from start to end of the cleaning operation, the main controller 110 determines that the cleaning member 81 is within the scanning range of the light beam. Specifically, when the number of detection times of the image defect part MP has not reached the threshold number of times (the estimated number of passing times for the cleaning member 81 to pass through the position P of the light emitting window 61 corresponding to the density detecting position DP), the main controller 110 determines that the cleaning member 81 is within the scanning range of the light beam L. In this way, without an additional detection sensor for detecting a position of the cleaning member 81, it is possible to determine whether or not an error has occurred in the cleaning operation. Therefore, the number of components (cost) is not increased.

In addition, in this embodiment, after the window cleaning device 8 finishes the cleaning operation as described above, when the main controller 110 determines that the cleaning member 81 is within the scanning range of the light beam, the cleaning member 81 is moved to the initial position IP outside the scanning range of the light beam L as the retry operation. In this way, it is possible to prevent the image formation process (including the exposing process by the exposure device 5) from being performed with the cleaning member 81 being within the scanning range of the light beam L. In other words, it is possible to suppress occurrence of the inconvenience (quality deterioration of the printed image) caused when the light beam L blocks cleaning member 81.

In addition, in this embodiment, when the retry operation is performed, the main controller 110 controls to emit the light beam from the light emitting window 61 so as to form the stripe image and detects the image defect part NP by the density detection sensor ID, as described above. In this way, the retry operation is easily performed, and hence it is possible to determine whether or not the cleaning member 81 has returned to the initial position IP (whether or not the cleaning member 81 has moved outside the scanning range of the light beam L).

Further, when the total number of the number of detection times of the image defect part NP after the cleaning operation detected by the main controller 110 and the number of detection times of the image defect part NP after the retry operation reaches the threshold number of times, the window cleaning device 8 finishes the retry operation. Therefore, unnecessary retry operation is not performed.

In addition, in this embodiment, as described above, the window cleaning device 8 repeats the retry operation when the total number of detection times has not reached the threshold number of times. Here, even if the cleaning member 81 cannot be returned to the initial position IP by the first retry operation, the cleaning member 81 may be returned to the initial position IP after the retry operation is repeated a plurality of times. Therefore, when the cleaning member 81 cannot be returned to the initial position IP (when the total number of detection times has not reached the threshold number of times) by the first retry operation, it is preferred to repeat the retry operation.

In addition, in this embodiment, as described above, when the total number of detection times does not reach the threshold number of times after the retry operation is repeated a predetermined number of times, the window cleaning device 8 finishes the retry operation even if the total number of detection times has not reached the threshold number of times. Here, if the cleaning member 81 cannot be returned to the initial position IP (the total number of detection times does not reach the threshold number of times) after repeating the retry operation a plurality of times, there is a possibility that the cleaning member 81 cannot be moved for a certain reason. Therefore, in this case, it is preferred to finish the retry operation so as to reduce a load on the gear 84 or the motor M.

In addition, in this embodiment, as described above, when the total number of detection times does not reach the threshold number of times, the operation panel OP (notifying member) notifies that an error has occurred in the cleaning operation. In this way, it is possible to inform the user that maintenance is necessary.

In addition, in this embodiment, as described above, the main controller 110 adjusts the density of the toner image transferred onto the intermediate transfer belt 41 (performs the image density calibration). Then, when the main controller 110 adjusts the density of the toner image transferred onto the intermediate transfer belt 41, the main controller 110 detects the density of the toner image transferred onto the intermediate transfer belt 41 on the basis of the output of the density detection sensor ID. In other words, the density detection sensor ID used for detecting a position of the cleaning member 81 is a sensor used for the image density calibration. In this way, because it is not necessary to add another sensor for density detection, an increase of the number of components (cost) can be suppressed.

In addition, in this embodiment, as described above, when the main controller 110 controls the window cleaning device 8 to perform the cleaning operation, the main controller 110 controls to form the stripe image in such a manner that toner does not adhere to a position other than the density detecting position DP. In this way, it is possible to consume the toner wastefully.

In addition, in this embodiment, as described above, a plurality of density detection sensors ID are disposed with a predetermined interval in the main scanning direction. In this way, because there are the plurality of density detecting positions DP, it is possible to precisely determine whether or not the cleaning member 81 has returned to the initial position IP.

The embodiment disclosed here is merely an example in every point and should not be interpreted to be a limitation. The scope of the present disclosure is defined not by the above description of the embodiment but by the claims. Further, the scope of the present disclosure includes all modifications within the claims and equivalent meanings and ranges thereof.

What is claimed is:

1. An image forming apparatus comprising:

an image forming portion including image carriers, electrification members, exposure members and developing units for each color, so as to form toner images of individual colors on surfaces of the image carriers, respectively;

an intermediate transfer member disposed to face the image carriers so that each toner image formed on the image carriers are transferred and overlaid to form a color image thereon;

a light emitting window whose longitudinal direction is a main scanning direction, through which a light beam generated by the exposure member emits to scan and expose a surface of each of the image carriers in the main scanning direction;

a window cleaning device including a cleaning member which is moved in a reciprocating manner in the main scanning direction along the light emitting window so as to perform a cleaning operation in which the cleaning member cleans the light emitting window;

a controller configured to control operations of the image forming portion and for driving the window cleaning device to perform the cleaning operation at a predetermined time; and a density detecting member capable of detecting image density of a stripe image formed by the image forming portion in a predetermined position on the intermediate transfer member continuously in a vertical scanning direction perpendicular to the main scanning direction, wherein the controller controls the exposure members to emit the light beam through the light emitting window so that the stripe image is formed in the predetermined position when the window cleaning device performs the cleaning operation, so as to form an image defect part on the stripe image, which occurs when the light beam is intercepted by the cleaning member moving along the light emitting window in the main scanning direction, and detects the image defect part by the density detecting member, and the controller determines that the cleaning member stays within a scanning range of the light beam on the light emitting window when a predetermined number of the image defect parts are not formed in the predetermined position in a period from start to end of the cleaning operation.

2. The image forming apparatus according to claim 1, wherein the controller determines that the cleaning member stays within the scanning range of the light beam on the light emitting window when the number of detection times of the image defect part has not reached a threshold number of times which is an estimated number of passing times for the cleaning member to pass through a interception position on the light emitting window corresponding to the predetermined position in the cleaning operation.

3. The image forming apparatus according to claim 2, wherein the window cleaning device performs a retry operation for moving the cleaning member to an initial position outside the scanning range of the light beam when the controller determines that the cleaning member is within the scanning range of the light beam on the light emitting window after finishing the cleaning operation.

4. The image forming apparatus according to claim 3, wherein the controller controls to emit the light beam from the light emitting window so as to form the stripe image and detects the image defect part by the density detecting member during the retry operation is performed, and the controller controls the window cleaning device to finish the retry operation when the total number of detection times of the image defect part detected during the cleaning operation and the retry operation reaches the threshold number of times.

5. The image forming apparatus according to claim 4, wherein the window cleaning device repeats the retry operation when the total number of detection times has not reached the threshold number of times.

6. The image forming apparatus according to claim 5, wherein the window cleaning device repeats the retry operation a predetermined number of times and finishes the retry operation even if the total number of detection times has not reached the threshold number of times after the retry operation is repeated the predetermined number of times.

7. The image forming apparatus according to claim 6, further comprising a notifying member configured to notify that an error has occurred in the cleaning operation when the total number of detection times has not reached the threshold number of times.

8. The image forming apparatus according to claim 1, further comprising an calibration member configured to calibrate density of a toner image transferred onto the intermediate transfer member, wherein the density detecting member is a optical densitometer the calibration member calibrates the density of the toner image transferred onto the intermediate transfer member by the optical densitometer.

9. The image forming apparatus according to claim 1, wherein the controller controls the image forming portion to form the stripe image in such a manner that toner does not adhere to a position other than the predetermined position while performing the cleaning operation.

10. The image forming apparatus according to claim 1, wherein a plurality of numbers of the density detecting members are provided with a predetermined interval in the main scanning direction a plurality of the stripe image are formed in such a manner as parallel to each other in the vertical scanning direction.

* * * * *